US005325982A

United States Patent [19]

Cobb, Jr.

[11] Patent Number: 5,325,982

[45] Date of Patent: Jul. 5, 1994

[54] COMBINATION CAP AND HANDLE FOR A BEVERAGE CONTAINER

[75] Inventor: Bryce R. Cobb, Jr., Detroit, Mich.

[73] Assignee: BCI of Chicago, Inc., Oak Park, Ill.

[21] Appl. No.: 100,680

[22] Filed: Aug. 2, 1993

[51] Int. Cl.[5] ..... B65D 51/18

[52] U.S. Cl. ..... 220/212.5; 220/254; 220/375; 220/709; 220/710.5; 220/756; 215/1 A; 215/228; 215/229; 215/306; 215/100 A

[58] Field of Search ..... 215/1 A, 228, 229, 306, 215/100 A; 220/212, 212.5, 254, 375, 705, 709, 710.5, 756, 758, 759, 769

[56] References Cited

U.S. PATENT DOCUMENTS

D. 200,978 5/1965 Seltz .
3,191,819 11/1963 Smith .
3,847,311 11/1974 Flores et al. ..... 222/473
4,368,826 1/1983 Thompson .
4,456,135 6/1984 Beekes .
4,936,614 6/1990 Russell .
5,048,709 9/1991 Alverson .

*Primary Examiner*—Allan N. Shoap
*Assistant Examiner*—Nova Stucker
*Attorney, Agent, or Firm*—Silverman, Cass & Singer, Ltd.

[57] ABSTRACT

A single, integral cap and handle assembly adapted to be screwed on the narrow threaded open neck of a container. The cap has an access port in registry with the open neck and a resealable plug engageable in said port which plug is integrally formed with the cap. The handle is integral with the annular perimetric wall of the cap and is constructed and arranged to be positioned in close proximity to and parallel with the cylindrical body of the container. The handle has aligned openings for removably engaging and holding a straw which can be inserted through the open port of the cap and the neck of the bottle for drawing fluid therethrough from the container.

10 Claims, 2 Drawing Sheets

COMBINATION CAP AND HANDLE FOR A BEVERAGE CONTAINER

FIELD OF THE INVENTION

This invention relates to beverage containers, and more particularly, to a unitary cap and handle attachable to the open neck of the container for lifting, carrying and pouring, said cap including means for opening and resealing the cap and the handle including means for holding a straw.

BACKGROUND ART

The combination cap and handle is contemplated to be most beneficial when used with the common sports-type bottle containing refreshing liquids. Such bottles or containers generally are of the vacuum bottle type of suitable internal insulation structure for maintaining the temperature of the stored liquid relatively constant during storage over a protracted period time. Such bottles or containers generally include a cylindrical insulated liquid storage body which includes a narrowed open neck at the upper end of the body through which the liquid can be poured for filling the body or dispensed from the body. The combination cap and handle embodying the invention is removably attachable on the narrow neck.

Attention is invited to a group of known cap or cover structures for beverage containers. In U.S. Pat. No. 5,048,709 is shown a container cover which snaps over the open end of the container body and which includes a resealable plug for the dispensing opening in the cap. The plug has a strap formation perforated to hold a straw when the plug is engaged in the opening.

In U.S. Pat. No. 4,456,135 is shown a handle in combination with a resealing latch for installation on a neck of a bottle.

In U.S. Pat. No. 4,936,614 is shown a handle which can be mounted over a flange on the neck of the bottle for lifting, carrying and pouring. The cap for the bottle is separate from the handle. In U.S. Pat. No. 4,368,826 also is shown a separate handle for attaching to the narrowed neck of the bottle.

The structure embodying the invention provides a single, unitary assembly of a cap and handle with a resealable plug for the cap and means in the handle for retaining a straw. This combination cap and handle is most economical to manufacture from a synthetic plastic material, simple to install, use, remove and clean for installation again on the beverage container.

SUMMARY OF THE INVENTION

The present invention is a single, integral cap and handle assembly adapted to be screwed on the narrow threaded open neck of a container. The cap has an access port in registry with the open neck and a resealable plug engageable in said port which plug is integrally formed with the cap. The handle is integral with the annular perimetric wall of the cap and is constructed and arranged to be positioned in close proximity to and parallel with the cylindrical body of the container. The handle has aligned openings for removably engaging and holding a straw which can be inserted through the open port of the cap and the neck of the bottle for drawing fluid therethrough from the container.

DESCRIPTION OF THE PREFERRED EMBODIMENT

Figure 1:
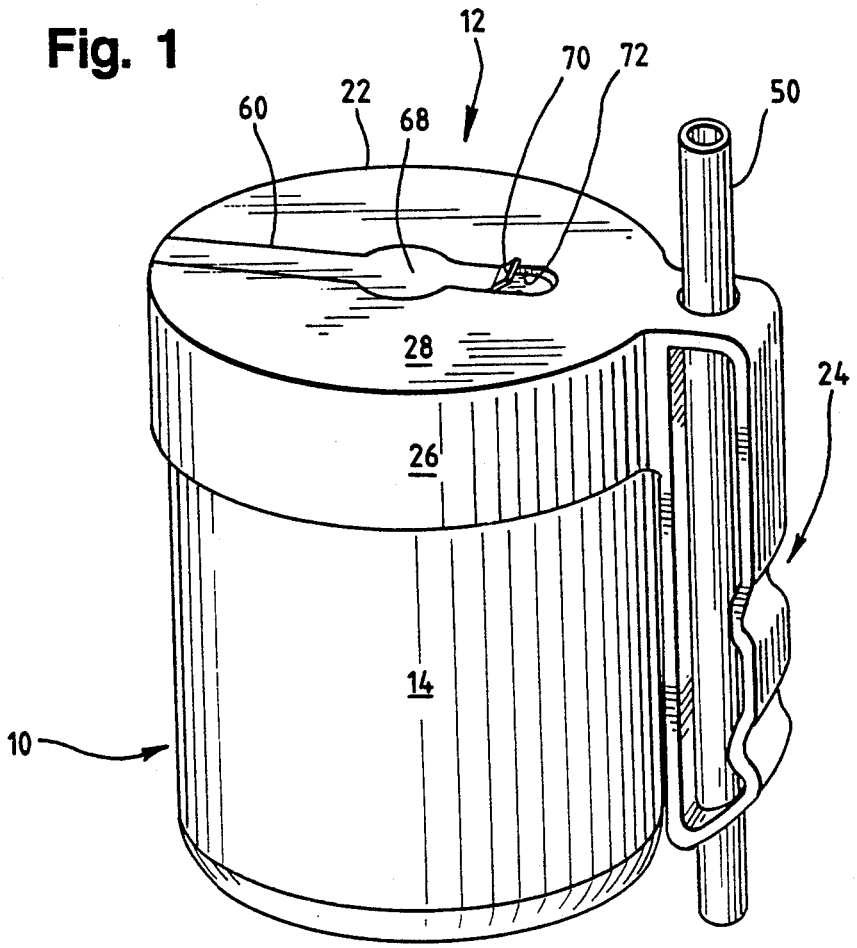
FIG. 1 is a perspective view of the combination cap and handle embodying the invention installed on a beverage container body and with the resealable plug thereof in closed position on the cap and with a straw supported in the handle.

As shown in the drawings, the beverage container is designated generally by the reference character 10 and the combination cap and handle embodying the invention is designated generally by the reference character 12.

The container 10 preferably is of the insulated type typically referred to as a vacuum type beverage container. It is comprised of an elongated cylindrical body 14 of double wall insulated construction having an open upper end 15 and closed bottom end 16. Secured over the upper end 15 is an annular dome-like formation 18 having a narrow, open-ended externally threaded neck 20 upstanding therefrom.

Figure 4:
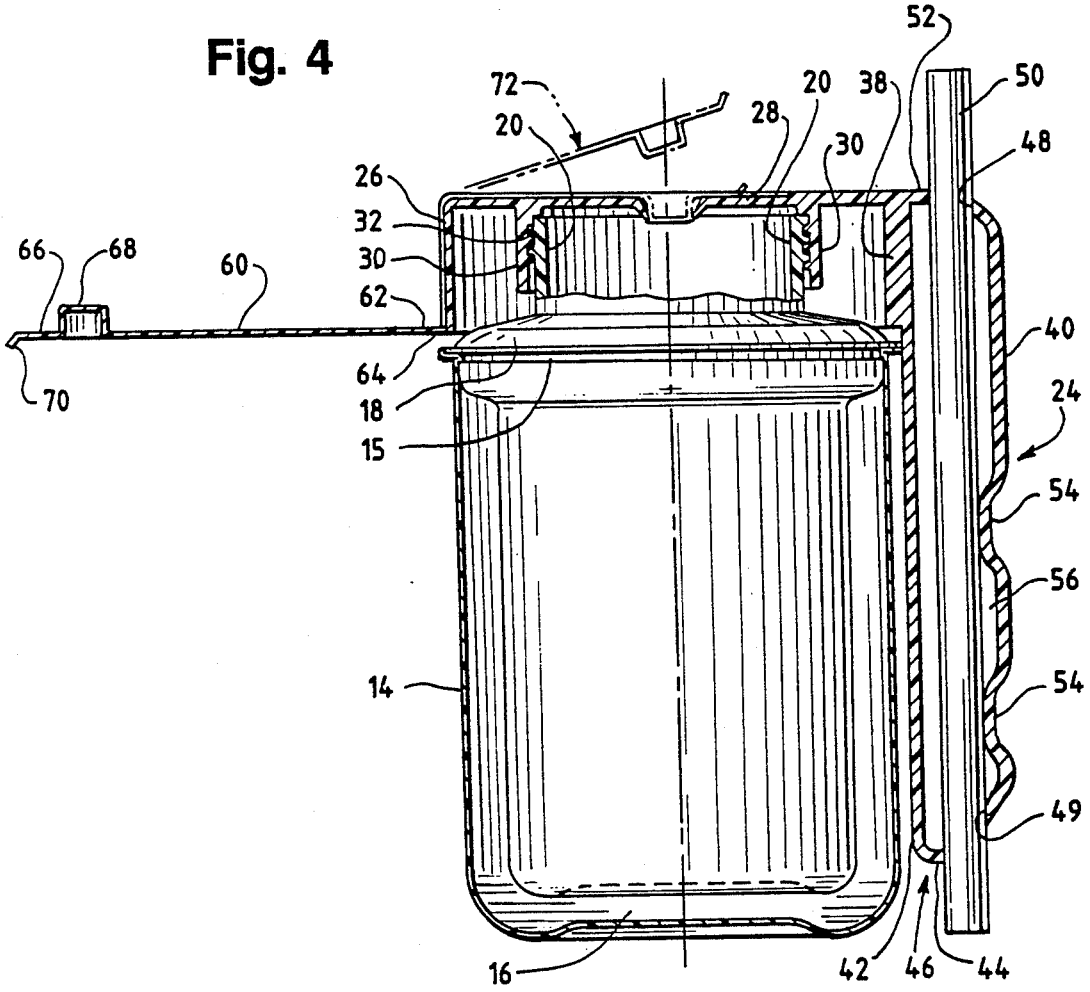
FIG. 4 is a sectional view taken through assembly along the line 4—4 in FIG. 3 and in the general direction indicated.

The combination cap and handle 12 is engaged over the threaded neck 20 as seen in FIG. 4. The cap portion is designated generally 22 and the handle portion is designated generally 24. Cap portion 22 is comprised of an annular circumstantial wall 26 on which is formed a flat closure wall 28. Depending from the inner surface of wall 28 is a cylindrical wall 30 having the internal threads 32. The inside diameter of the wall 30 is selected so that the threads 32 can be threadedly engaged over the threaded neck 20 for installing the cap portion 22 as seen in FIG. 4.

The closure wall 28 has a port 34 therethrough aligned with the open end of the neck 20. The circumstantial wall 26 has an axial length so as to reach to the dome formation 18 and a suitable diameter to complement the diameter of the container body 14 for presenting an agreeable aesthetic appearance for the assembled cap and handle 12 and container 10 as seen in FIG. 1.

The handle part 24 is integrally formed with the thickened wall segment 38 of the cap part 22, which is provided as a chord of the annular wall 26. The handle part 24 is comprised of an elongated linear segment 40 which is a continuation of the wall 28 and extends downwardly therefrom to join the elongated segment 42 by means of the arcuate segment 44. The segment 42 extends upwardly toward and joining the cap part a the thickened segment 38. The elongated segments 40 and 42 extend substantially parallel and spaced apart one from the other and parallel to the longitudinal axis of the container body 14 and spaced from the circumstantial wall of the body 14 as seen from the space designated 46 in FIG. 4 for facilitating gripping the handle.

The handle part 24 has a pair of aligned openings 48 and 50 for accommodating a straw 50 as seen in FIG. 4. The opening 48 is formed in the upper segment 52 which joins elongate segment 40 to the cap wall 38. The opening 50 is formed in the lower connecting segment 44. Formed on the elongate segment 40 is a pair of straw gripper formations which are provided by the indented, arcuate deformations 54 extending inwardly toward the segment 42 and thereby decreasing the spacing 56 therebetween. As seen in FIG. 4, the straw 50 is inserted into the openings 48 and 49 to protrude outwardly from opposite ends of the handle part 24 and retained in place in the handle part 24 by the deformations 54 bearing against the straw.

As thusly rigidly secured to the annular cap part 22, the handle 24, the assembly of the cap and handle 12 to the container body can be lifted easily for carrying and pouring of liquid from the container body 14. The user grips the handle with fingers inserted in space 46.

Figure 2:
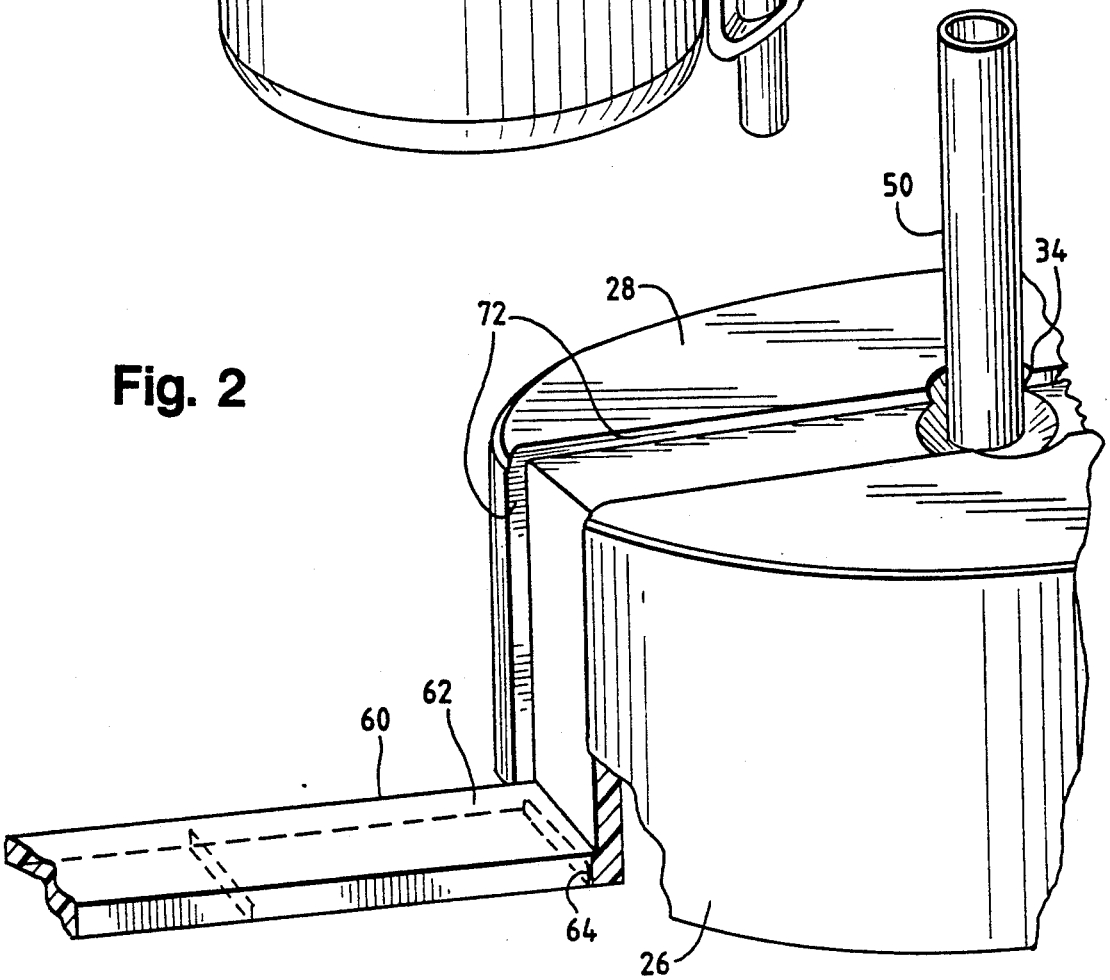
FIG. 2 is a fragmentary perspective view of said cap with the resealable plug in a withdrawn position to permit the straw to be inserted through the port in the cap into the container body.
Figure 3:
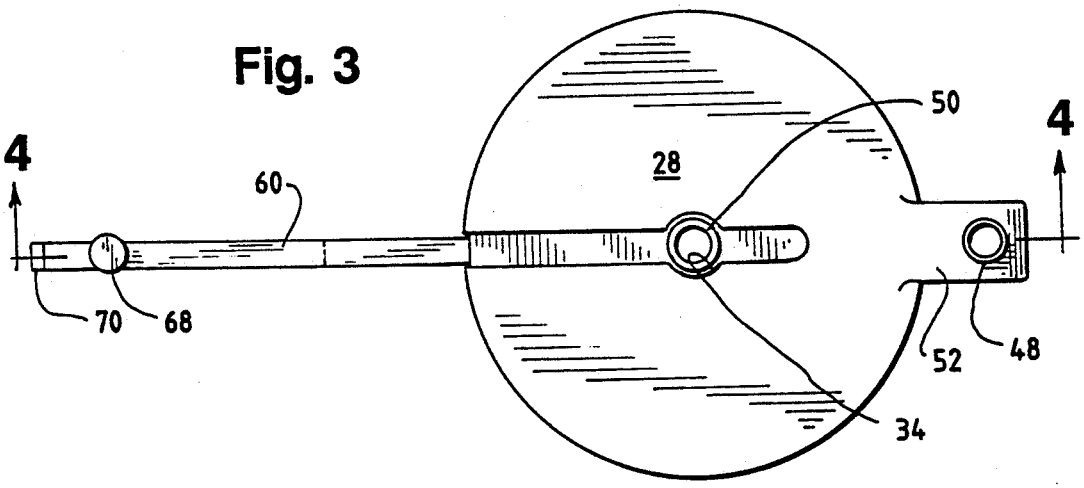
FIG. 3 is a top elevation view of the invention as shown in FIG. 2.

The resealable closure for the structure 12 is comprised o±a plastic strap 60 attached at one end thereof 62 to the annual wall of the cap part at 64 which is opposite the thickened segment 38. Adjacent the opposite end 66 of the strap 60 is an upstanding plug formation 68 which is dimensioned to be wedged into the port 34 for closing it. The small tab 70 extending beyond the plug 68 is available for pulling the plug 68 from the port 34 for opening the same so as to permit insertion of the straw 50 into the container body as seen in FIG. 2. The port 34 is shown open in FIG. 3 and the straw 50 engaged therein.

As shown in phantom outline 72 in FIG. 4, the plug is shown in a poised positioned either for closing or opening the port 34.

Referring to FIGS. 1 and 2 the cap wall 28 is provided with a flat groove formation 72 which extends along the diameter of the wall 28 and downwardly along the perimetric wall 26 of the cap. The dimensions of the groove 72 are selected to permit the strap 60 to be accommodated entirely within the groove 72 when the closure plug 68 is seated in the port 34 for closing the cap 22 and hence the container 14. Thus seated in the groove 72, the strap 60 is flush with the outside surface of wall 28. The tab 70 will be upstanding slightly from cap wall 28 for ready gripping to open the cap port 34.

The combination cap and handle 12 preferably is formed from a suitably strong synthetic plastic economically and readily molded. In this case, attractive colors for the plastic can be used compatible with the color of the container body 14.

What is desired to be secured by Letters Patent is:

1. A combination cap and handle for a beverage container having a narrow open neck upstanding from the upper end of a container body, said combination cap and handle comprising:

a. a cylindrical cap having an annular perimetric wall, a top wall having a port therethrough and an open end opposite said top wall, an internal annular wall concentric with said perimetric wall and depending from said top wall in communication with said port, said depending wall constructed and arranged to be removably installed on said narrow open neck;

b. a handle formation integrally formed with the cap and extending downwardly from said top wall spaced from and parallel to the container body when the cap is installed;

c. said handle having axially aligned apertures for retaining a straw therein; and d. a resealable closure means for said port integrally formed with said cap.

2. A combination cap and handle for a beverage container having a narrow open neck upstanding from the upper end of a container body, said combination cap and handle comprising:

a. a cylindrical cap having an annular perimetric wall, a top wall having a port therethrough and an open end opposite said top wall, an internal annular wall concentric with said perimetric wall and depending from said top wall in communication with said port, said depending wall constructed and arranged to be removably installed on said narrow open neck;

b. a handle formation integrally formed with the cap and extending downwardly from said top wall spaced from and parallel to the container body when the cap is installed;

c. said handle having means for retaining a straw therein;

d. a resealable closure means for said port integrally formed with said cap; and e. said open neck of the container being externally threaded and said depending annular wall is internally threaded for threaded engagement with the neck for installing the cap on the container.

3. The combination cap and handle of claim 2, in which said perimetric wall has a thickened segment and said handle formation is integral with said thickened segment.

4. A combination cap and handle for a beverage container having a narrow open neck upstanding from the upper end of a container body, said combination cap and handle comprising:

a. a cylindrical cap having an annular perimetric wall, a top wall having a port therethrough and an open end opposite said top wall, an internal annular wall concentric with said perimetric wall and depending from said top wall in communication with said port, said depending wall constructed and arranged to be removably installed on said narrow open neck;

b. a handle formation integrally formed with the cap and extending downwardly from said top wall spaced from and parallel to the container body when the cap is installed;

c. said handle having means for retaining a straw therein;

d. a resealable closure means for said port integrally formed with said cap;

e. said perimetric wall has a thickened segment and said handle formation is integral with said thickened segment; and f. said handle formation comprises a pair of coextensive, elongated segments space done from the other and joined at opposite ends of the segments by a shorter segment transverse thereto, said shorter segments having openings therein for holding the straw.

5. The combination of claim 4 in which said means for retaining a straw therein comprises arcuate deformations in one of said elongated segments extending inwardly in the formation for engaging against said straw to hold the straw in the handle.

6. The combination of claim 4 in which said handle formation is sufficiently spaced from the container body for facilitating gripping of the handle by a user.

7. A combination cap and handle for a beverage container having a narrow open neck upstanding from the upper end of a container body, said combination cap and handle comprising:

a. a cylindrical cap having an annular perimetric wall, a top wall having a port therethrough and an open end opposite said top wall, an internal annular wall concentric with said perimetric wall and depending from said top wall in communication with said port, said depending wall constructed and arranged to be removably installed on said narrow open neck;

b. a handle formation integrally formed with the cap and extending downwardly from said top wall spaced from and parallel to the container body when the cap is installed;

c. said handle having means for retaining a straw therein;

d. a resealable closure mans for said port integrally formed with said cap; and e. said resealable closure means includes an elongate strap integrally formed with the perimetric wall of the cap at one end of the strap, said strap having a sealing plug at an opposing free end thereof suitable for engaging in said port.

8. The combination of claim 7 in which said cap has a flat groove in the top wall and perimetric wall for accommodating said strap flush mounted therein when the plug is engaged in the port.

9. The combination of claim 8 in which said strap includes a lift tap extending beyond the plug.

10. A combination cap and handle and a beverage container having a narrow open neck upstanding from the upper end of a container body, said combination cap and handle comprising:

a. a cylindrical cap having an annular perimetric wall, a top wall having a port therethrough and an open end opposite said top wall, an internal annular wall concentric with said perimetric wall and depending from said top wall in communication with said port, said open neck of the container and said depending annular wall having cooperating fastening means for removably installing the cap on the container;

b. a handle formation integrally formed with the cap and extending downwardly from said top wall spaced from and parallel to the container body when the cap is installed, said handle having axially aligned apertures for supporting a straw therein; and c. a resealable closure means for said port integrally formed with said cap.

* * * * *

UNITED STATES PATENT AND TRADEMARK OFFICE

CERTIFICATE OF CORRECTION

PATENT NO. : 5,325,982
DATED : July 5, 1994
INVENTOR(S) : Bryce Ronald Cobb, Jr.

It is certified that error appears in the above-indentified patent and that said Letters Patent is hereby corrected as shown below:

Column 2, lines 62-63, change "circumstantial" to --circumferential--;

Column 3, line 17, change "o±" to --of--;

Column 4, line 54, change "space done" to --spaced one--.

Signed and Sealed this

Sixth Day of September, 1994

*Attest:*

*Attesting Officer*

BRUCE LEHMAN

*Commissioner of Patents and Trademarks*